US009085118B2

(12) United States Patent
Iacobucci

(10) Patent No.: US 9,085,118 B2
(45) Date of Patent: Jul. 21, 2015

(54) TRASH COMPACTOR

(75) Inventor: Lucio Iacobucci, Rome (IT)

(73) Assignee: Iacobuccci HF Aerospace S.P.A., Ferentino (IT)

( * ) Notice: Subject to any disclaimer, the term of this patent is extended or adjusted under 35 U.S.C. 154(b) by 404 days.

(21) Appl. No.: 13/394,324

(22) PCT Filed: Sep. 24, 2010

(86) PCT No.: PCT/IT2010/000406

§ 371 (c)(1),
(2), (4) Date: Mar. 5, 2012

(87) PCT Pub. No.: WO2011/036690

PCT Pub. Date: Mar. 31, 2011

(65) Prior Publication Data

US 2012/0167787 A1 Jul. 5, 2012

(30) Foreign Application Priority Data

Sep. 25, 2009 (IT) ..... RM2009A0490

(51) Int. Cl.

| | |
|---|---|
| ***B30B 1/18*** | (2006.01) |
| ***B30B 9/30*** | (2006.01) |
| ***B30B 15/04*** | (2006.01) |

(52) U.S. Cl.

CPC ..... *B30B 9/3064* (2013.01); *B30B 1/18* (2013.01); *B30B 9/3021* (2013.01); *B30B 15/041* (2013.01)

(58) Field of Classification Search

CPC .. B30B 15/041; B30B 9/3021; B30B 9/3064; B30B 1/18; B30B 1/181

USPC ..... 100/100, 215, 226, 229 A, 240, 245, 100/246, 287, 289, 290, 48

See application file for complete search history.

(56) References Cited

U.S. PATENT DOCUMENTS

| | | | | |
|---|---|---|---|---|
| 3,352,230 | A | 11/1967 | Hunnicutt | |
| 3,590,437 | A * | 7/1971 | Annis et al. | 425/149 |
| 3,643,589 | A | 2/1972 | Carter | |
| 3,995,543 | A * | 12/1976 | Montalbano | 100/343 |
| 4,088,071 | A | 5/1978 | Cruse et al. | |
| 4,188,877 | A * | 2/1980 | Khan | 100/290 |
| 4,565,125 | A * | 1/1986 | Khan | 100/214 |
| 5,179,895 | A * | 1/1993 | Bauer | 100/193 |
| 7,089,852 | B2 | 8/2006 | Iacobucci | |

FOREIGN PATENT DOCUMENTS

| | | |
|---|---|---|
| CH | 697 513 | 4/2005 |
| DE | 2238732 A1 | 2/1974 |
| DE | 2301751 A1 | 7/1974 |

(Continued)

OTHER PUBLICATIONS

Baradat, Jean-Luc, Search Report, ITRM20090490, Sep. 25, 2009.

*Primary Examiner* — Jimmy T Nguyen

(74) *Attorney, Agent, or Firm* — Gregory P. Einhorn; Greer Burns & Crain, Ltd.

(57) ABSTRACT

Provided are electro-mechanical waste compactors which can operate also with 28 V power and of particularly reduced dimensions and weight. Provided are waste compaction devices which can be employed for civil uses, auxiliary service equipment, as, for example, trains, ships and vessels in general, aircrafts, coaches, caravans etc. Provided are compaction devices that can be conveniently installed in appropriate bays, fixed or movable on wheels, such as a trolley, to allow its ease of movement, and its insertion in the appropriate service spaces.

19 Claims, 10 Drawing Sheets

(56) References Cited

FOREIGN PATENT DOCUMENTS

| | | | |
|---|---|---|---|
| DE | 2434069 | A1 | 1/1976 |
| DE | 7710371 | | 8/1977 |
| DE | 20218428 | U1 | 11/2002 |
| FR | 2040909 | A5 | 1/1971 |
| FR | 2546128 | A1 | 11/1984 |

* cited by examiner

TRASH COMPACTOR

This application is a national phase patent utility filing under 35 USC §371, for international application no. PCT/IT2010/000406, filed on 24 Sep. 2010, which claims the benefit of priority to Italian patent application serial no. RM 2009 A 000490, filed 25 Sep. 2009. The aforementioned applications are explicitly incorporated herein by reference in their entirety and for all purposes.

FIELD OF THE INVENTION

Provided are electro-mechanical waste compactors which can work also at 28 V and is of particularly reduced dimensions and weight. Provided are devices for waste compaction which can be employed for use in non-mobile environments (in particular domestic environments, restaurants, hotels, canteens, hospitals, etc.) or mobile environments, for example on board of all the transportation means that require a great economy of space for the auxiliary service equipment, as trains, ships, aircrafts, coaches, caravans etc. Provided are compaction devices of the invention that can be conveniently installed in appropriate bays, fixed or movable on wheels, such as a trolley, to allow its easy displacement in the means of transportation and its insertion in the appropriate service spaces.

PRIOR ART

The trash compactors used for example in aircrafts must satisfy specific requirements in response to strict aeronautical rules. In fact, the fittings installed on civil aircrafts must have well-defined dimensions and structural features, as they must be able to bear the loads provided for by the rules in force. They, moreover, must be housed and kept safely fixed in appropriate bays arranged inside the aircrafts during the flight phase, and they must respond to more strict weight requirements. In fact, a reduction of weight even of a single kilogram for each item of collateral equipment on board of an aircraft brings to a considerable aircraft energy and operating savings in the long run. For a long time the compactors have been operated through hydraulic systems that made them unsuitable for the use on aircrafts. They, in fact, involved large dimensions of the compaction device, a great need for electrical power, the use of a pressurized oily fluid in a significant quantity, and the use of activation and control systems, structurally complicated and of difficult realization and maintenance. The elimination of the hydraulic device brings about remarkable benefits, allowing to avoid pressurized oil dynamic-type components which are often a source of unwanted damages and are potentially dangerous on board of an aircraft. In U.S. Pat. No. 7,089,852 to the same Applicant it is described an electro-mechanical waste compactor for aircrafts. This compactor includes a metallic horizontal compaction plate which is activated by means of an electric motor that works on two telescopic screws. The engine is placed in a central position with respect to the two telescopic screws which are directly connected to it by means of reducers.

The structure with two telescopic screws is cumbersome, and it doesn't provide a suitable guide to the translation in plane of the metal compaction plate.

The problem of the translation of the metal compaction plate was also described in patent FR 2040909 related to a waste compaction device having a metal compaction plate connected to a counterplate by means of four small angular pillars which run on bushings belonging to a single element of guide integral with the motor unit. The structure therein mentioned does not represent an arrangement that guarantees a perfect translation to the metallic compaction plate and it also takes up space as well as it doesn't discharge adequately the compression forces.

Also U.S. Pat. No. 3,643,589 describes a very long, and therefore cumbersome, waste compactor, in which the compaction plate is the base of a prismatic solid whose lateral walls run on antifriction elements. With the use, the parallelism of the lateral walls with the slip direction of the compaction plate tend to fail.

Similarly, FR 2546128 and U.S. Pat. No. 4,088,071 describe waste compactors in which the issues of clearance of the compactor structure and of the slip of the mobile part with respect to the fixed part of the compactor are not tackled.

DE 2434069 describes a transportable waste compactor comprising a fixed part that includes an electric engine and a mobile part that includes a horizontal compaction plate activated by the electric engine by means of a pulleys drive and a screw-type handling device which transforms the rotatory motion in translational motion. The compaction plate is integral with a kind of prismatic piston whose lateral edges are sites for guide elements that allow to the piston to slide. The compactor according to the German patent has, therefore, overall dimensions that, based on the length of its stroke and from the use of a very long screw, does no allow its use in practice in narrow spaces.

INVENTION OVERVIEW

Provided are devices of waste compaction.

Provided are waste compaction devices for use for example in houses, hotels, hospitals, restaurants (in particular in kitchens) or on means of transportation such as for example trains, ships, airplanes, coaches, caravans and in general in all the environments and the means of transportation that require a large economy of space for the auxiliary service equipment. Provided are waste compaction devices suitable for use on private aircrafts of small dimensions and in accordance with the aeronautical provisions in force, that has reduced overall dimensions and a perfectly linear sliding system between a fixed part and a mobile part of the compaction device.

The compaction device of the invention, is made with a fixed part and a mobile part and allows a partial interpenetration of the mobile part inside the fixed part and sliding by means of at least one rail made integral to the fixed part on a respective slide made integral to the mobile part and engaged with the rail.

Advantageously, a rail and its respective slide, and another rail and its respective slide arranged rotated of 90° with respect to the former, on two consecutive sides of the compaction device can be used.

The waste that can be processed with this device are, typically, cans, glass or plastic bottles, plastic tableware, aluminium trays for food and drink, boxes, tetrapak packages, etc.

A further object of the invention is the combination of the compacting device of the invention with a waste-holding compartment, the whole inserted in a "case" or a structure, or framework, or, more generically, a housing, or a galley that allows its rational arrangement in appropriate spaces of the structure in which the equipment for possible accessory services are installed such as those present in a fitted kitchen or on a transportation means.

Further objects will be evident from the following detailed description of the invention, with reference to its preferred embodiments, and it is understood that variations can be made without leaving the protection scope defined by the attached claims and making reference to the attached figures.

Figure 1A:
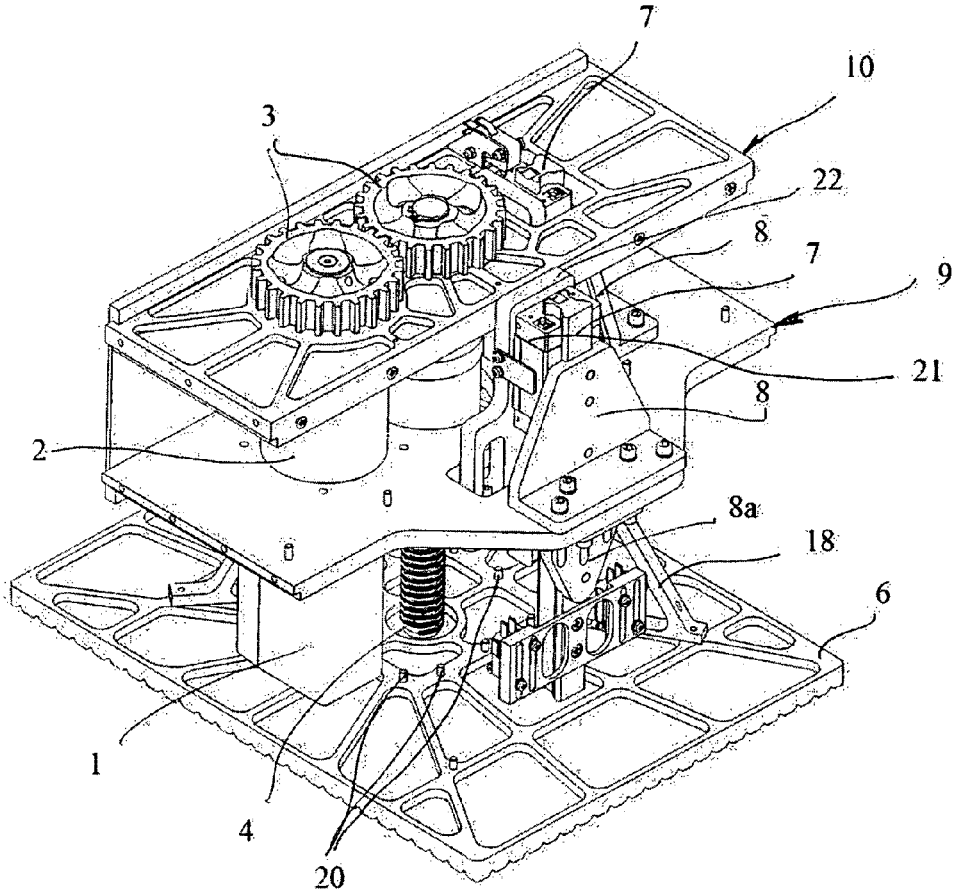
FIG. 1*a* is a schematic perspective view of the waste compaction device of the invention wherein the compaction plate is in a lifted position.
Figure 1B:
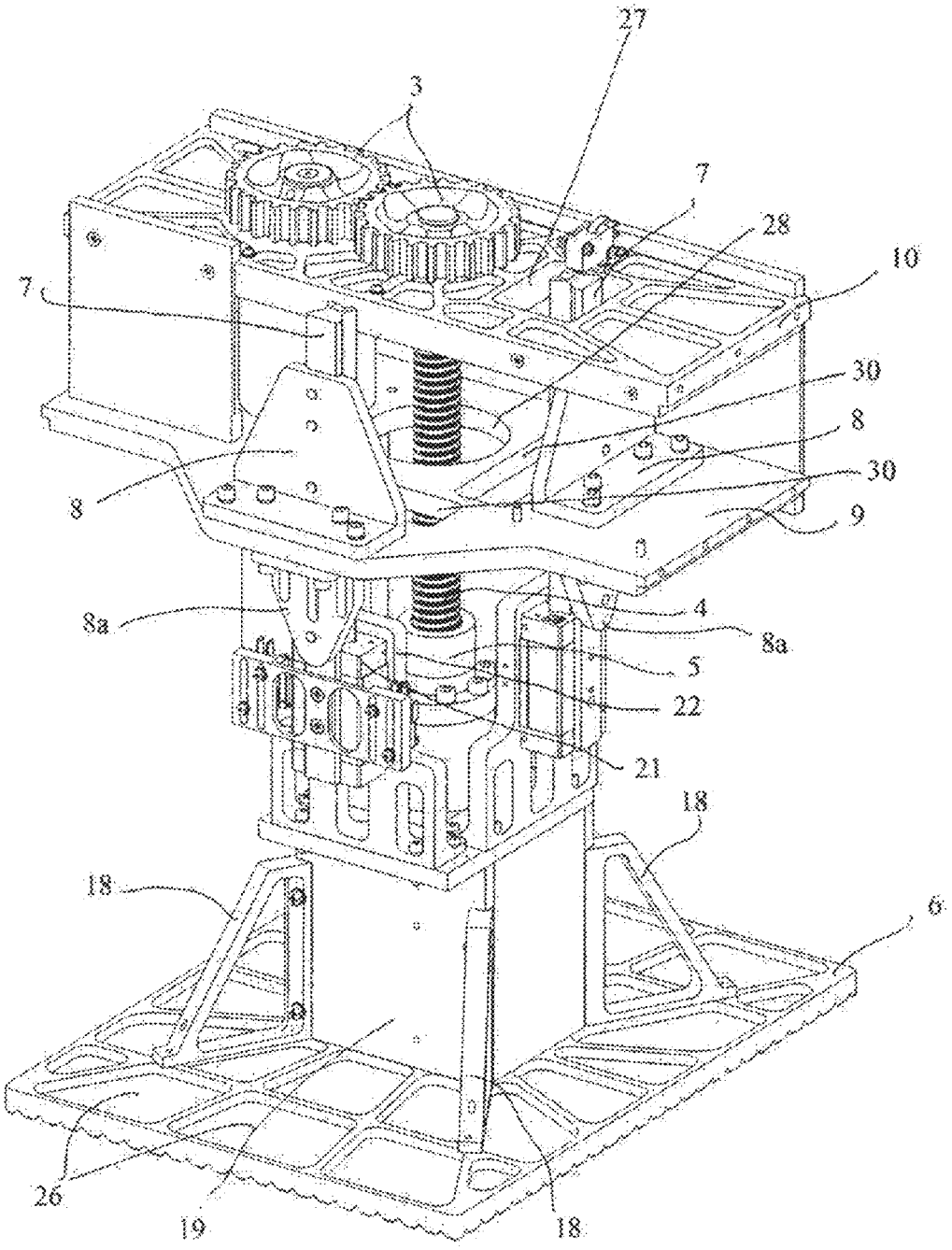
Figure 2:
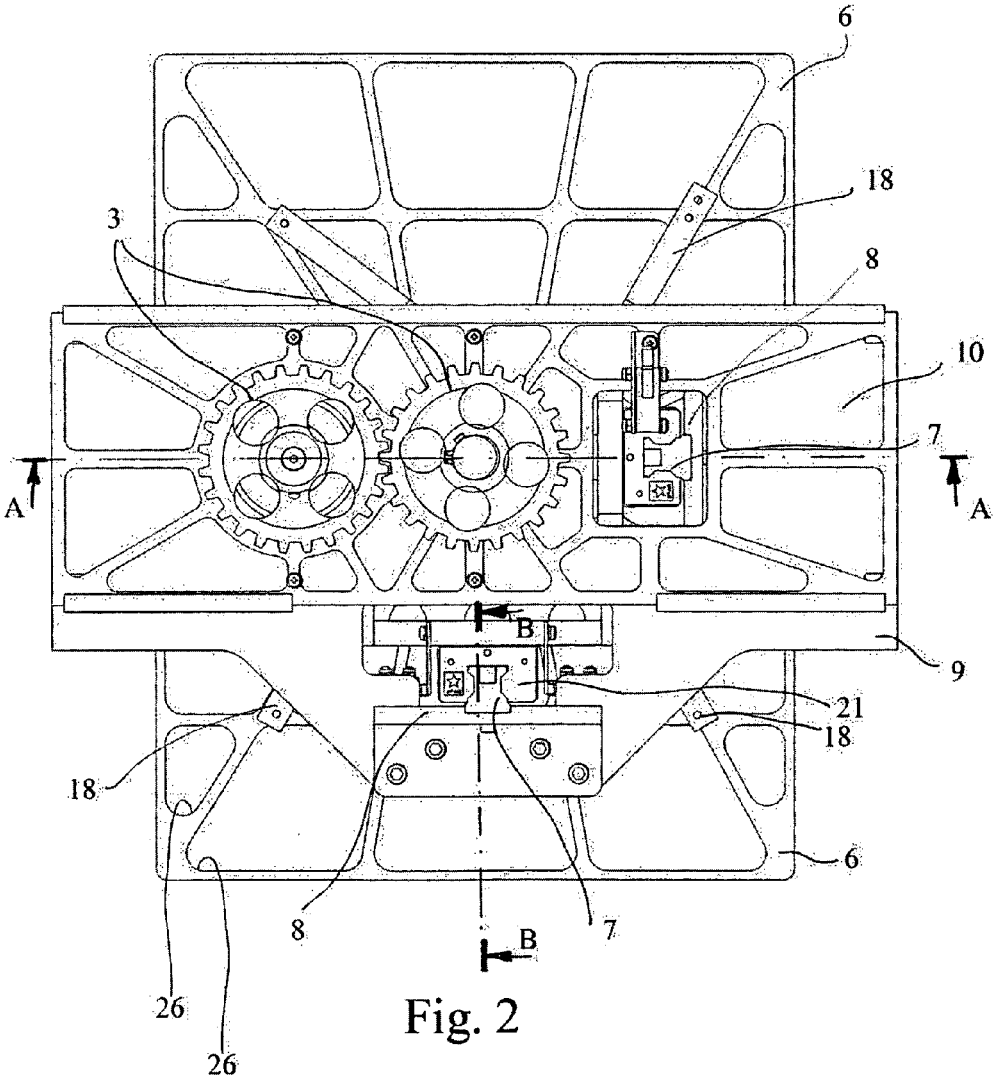
Figure 3A:
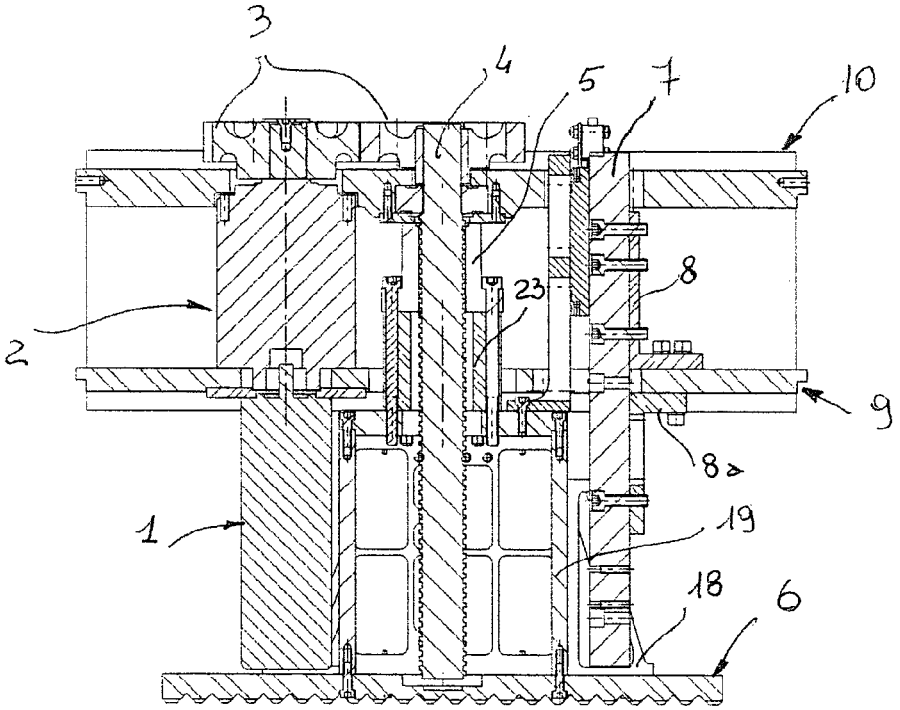
Figure 3B:
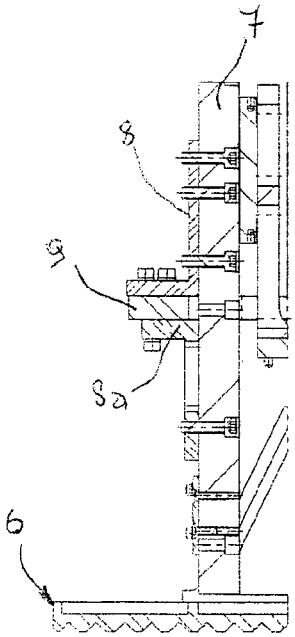
Figure 4A:
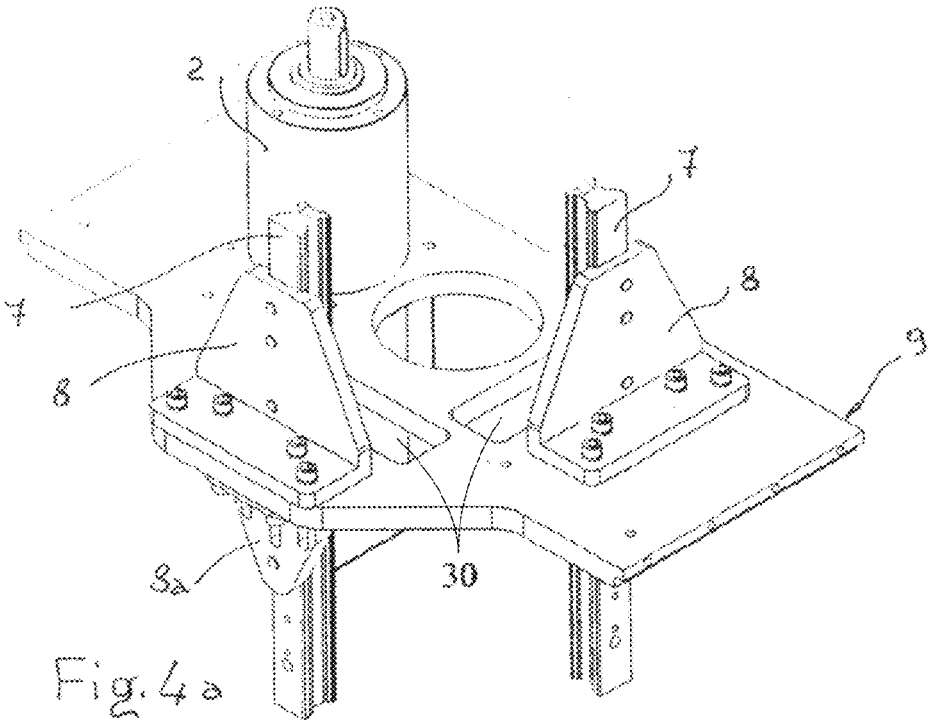
Figure 4C:
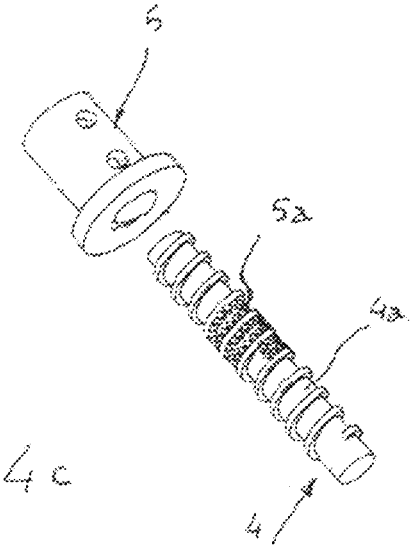
Figure 4B:
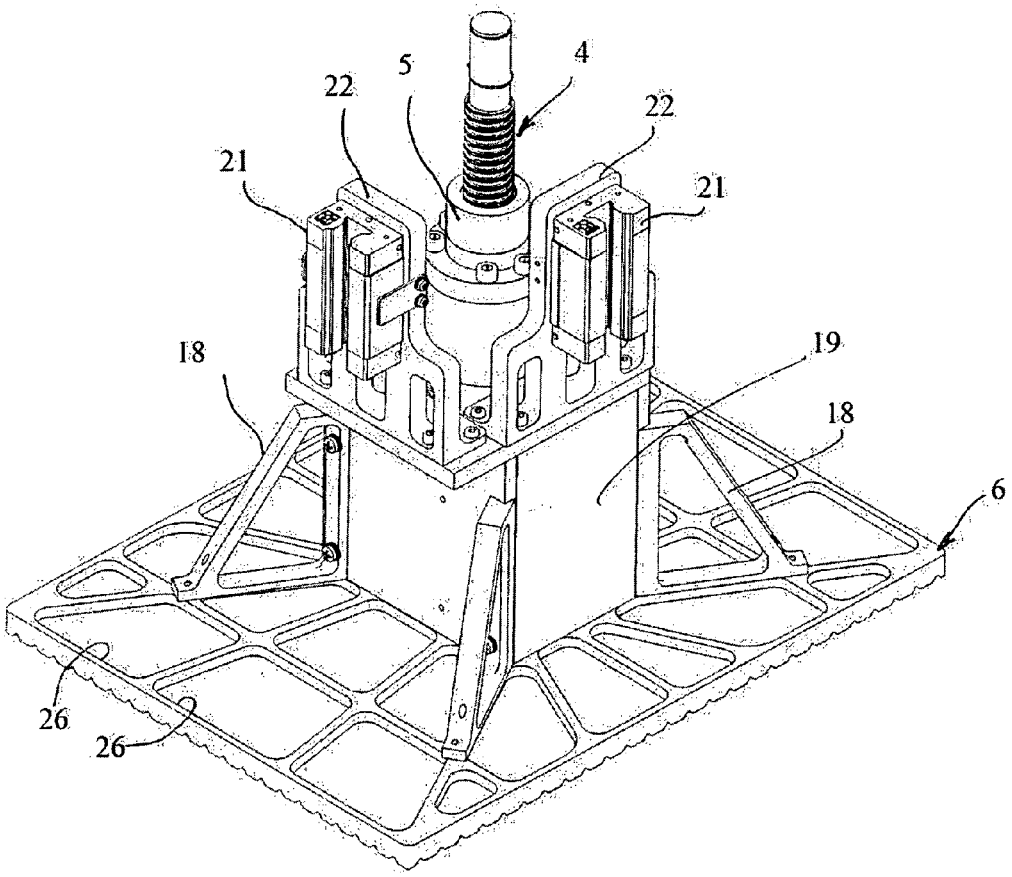
Figure 5:
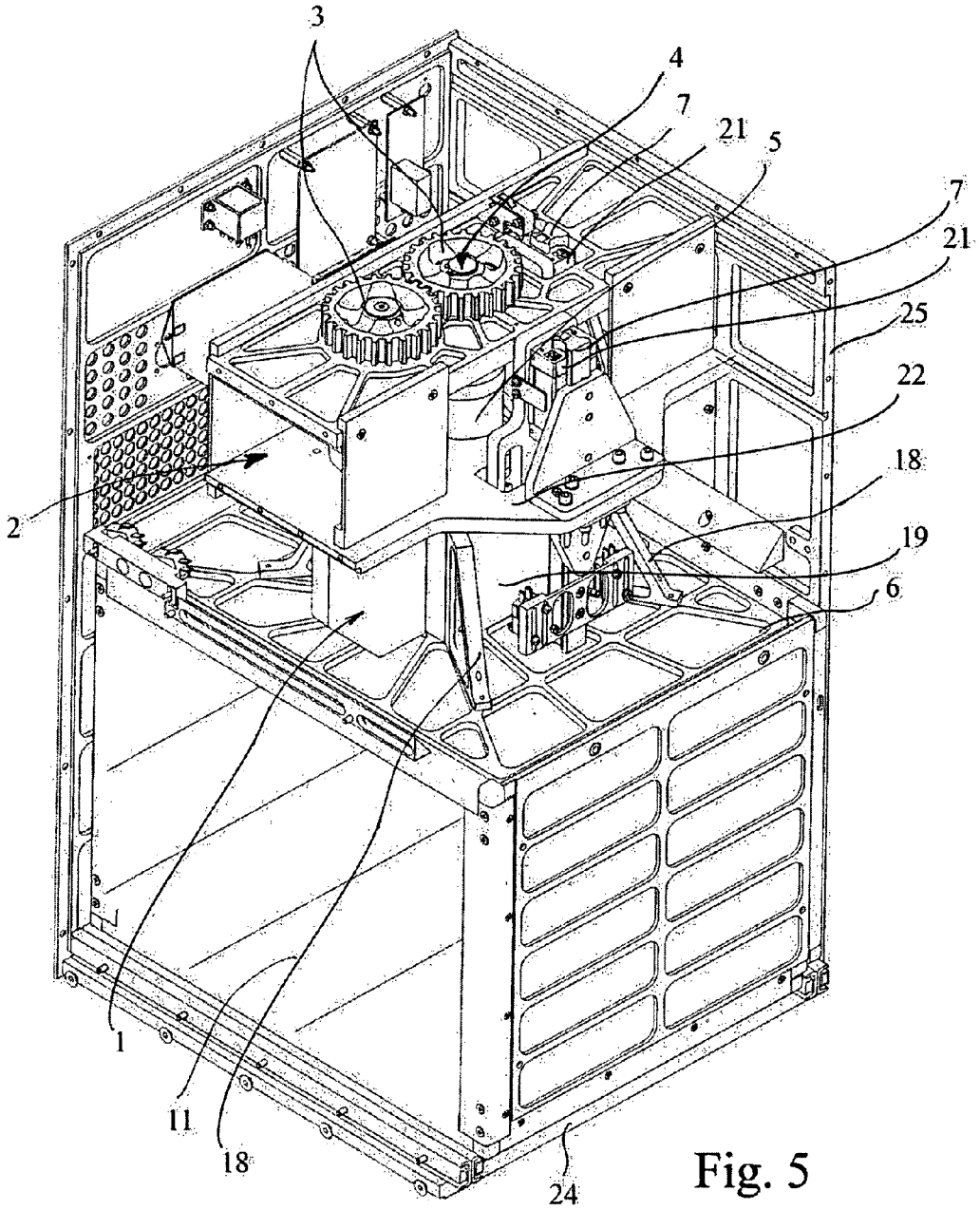
Figure 6:
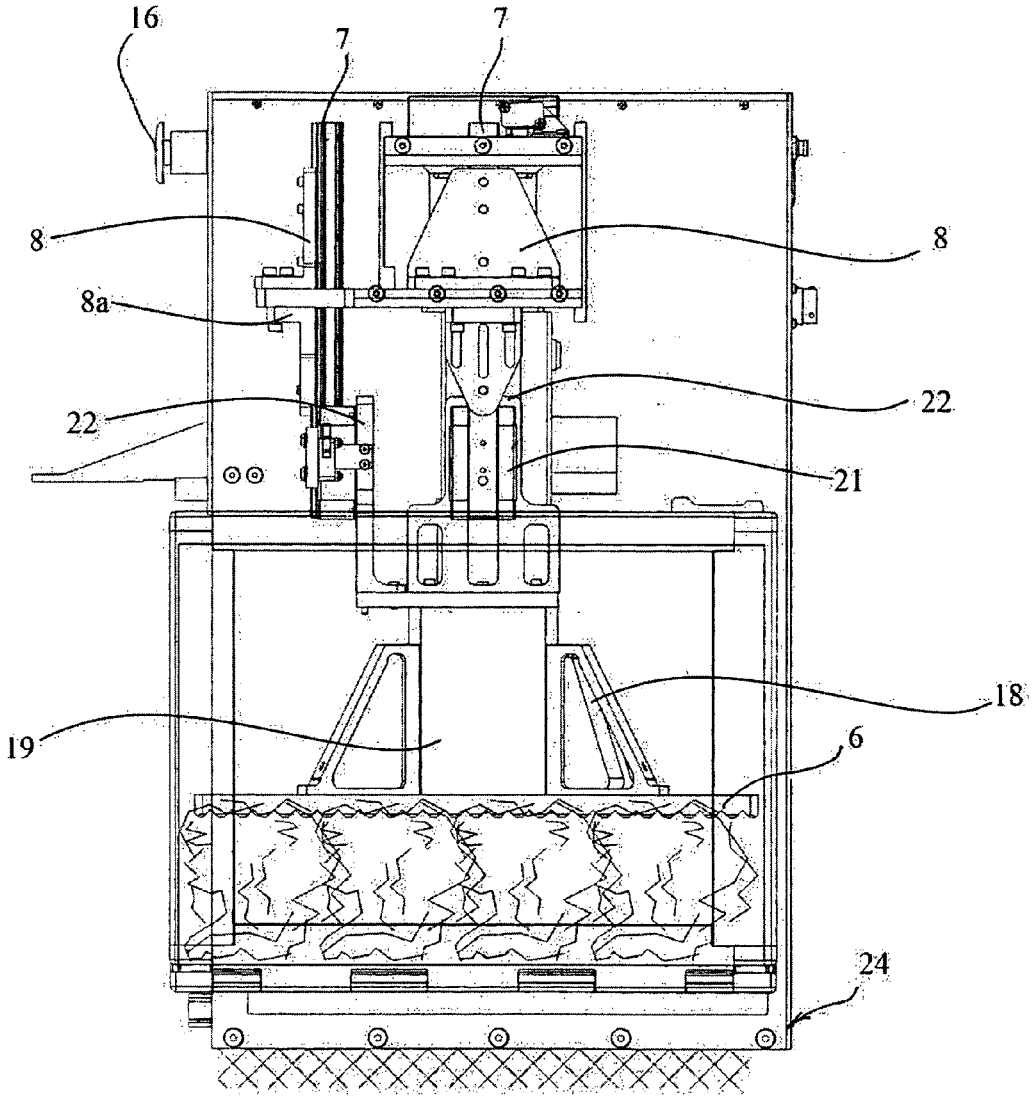
Figure 7:
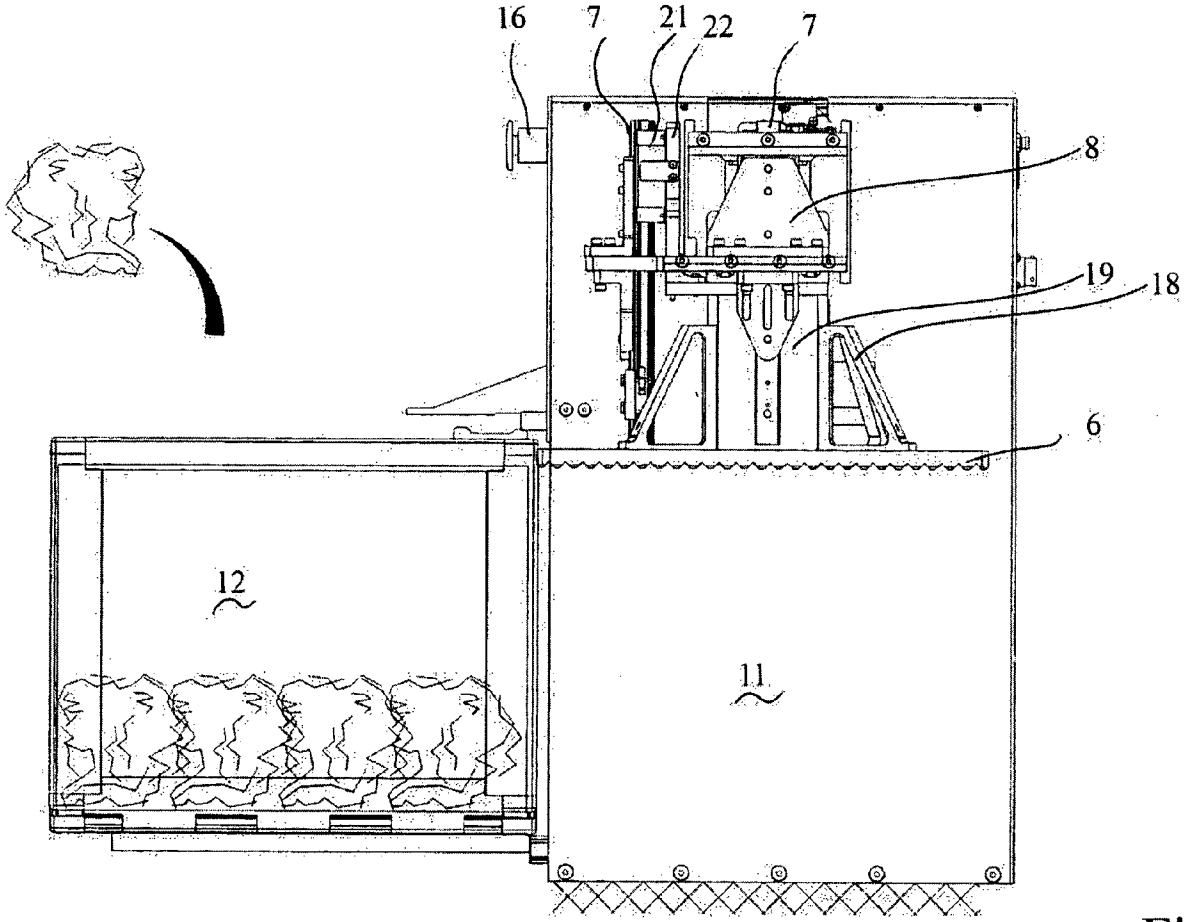

The FIG. 1*b* is a schematic perspective view of the waste compaction device of the invention wherein the compaction plate is in a lowered position;

The FIG. 2 is a view from the top of the waste compaction device of the invention;

The FIG. 3*a* is a section obtained with a plane of trace A-A in the FIG. 2;

The FIG. 3*b* is a section obtained with a plane of trace B-B in the FIG. 2;

FIG. 4*a* is a schematic perspective view of a few elements comprised in the fixed part of the waste compaction device of the invention;

FIG. 4*b* is a schematic perspective view of a few elements comprised in the mobile part of the waste compaction device of the invention;

FIG. 4*c* is a schematic perspective view of the flange nut/endless screw combination of the waste compaction device of the invention;

FIG. 5 is a schematic perspective view of the waste compaction device of the invention and of the "case", partially shown, in which it is housed;

FIGS. 6 and 7 are two vertical longitudinal sections of the "case" comprising the waste compaction device of the invention;

FIG. 6 with a waste-holding drawer inserted and

FIG. 7 with the drawer completely open; and

Figure 8:
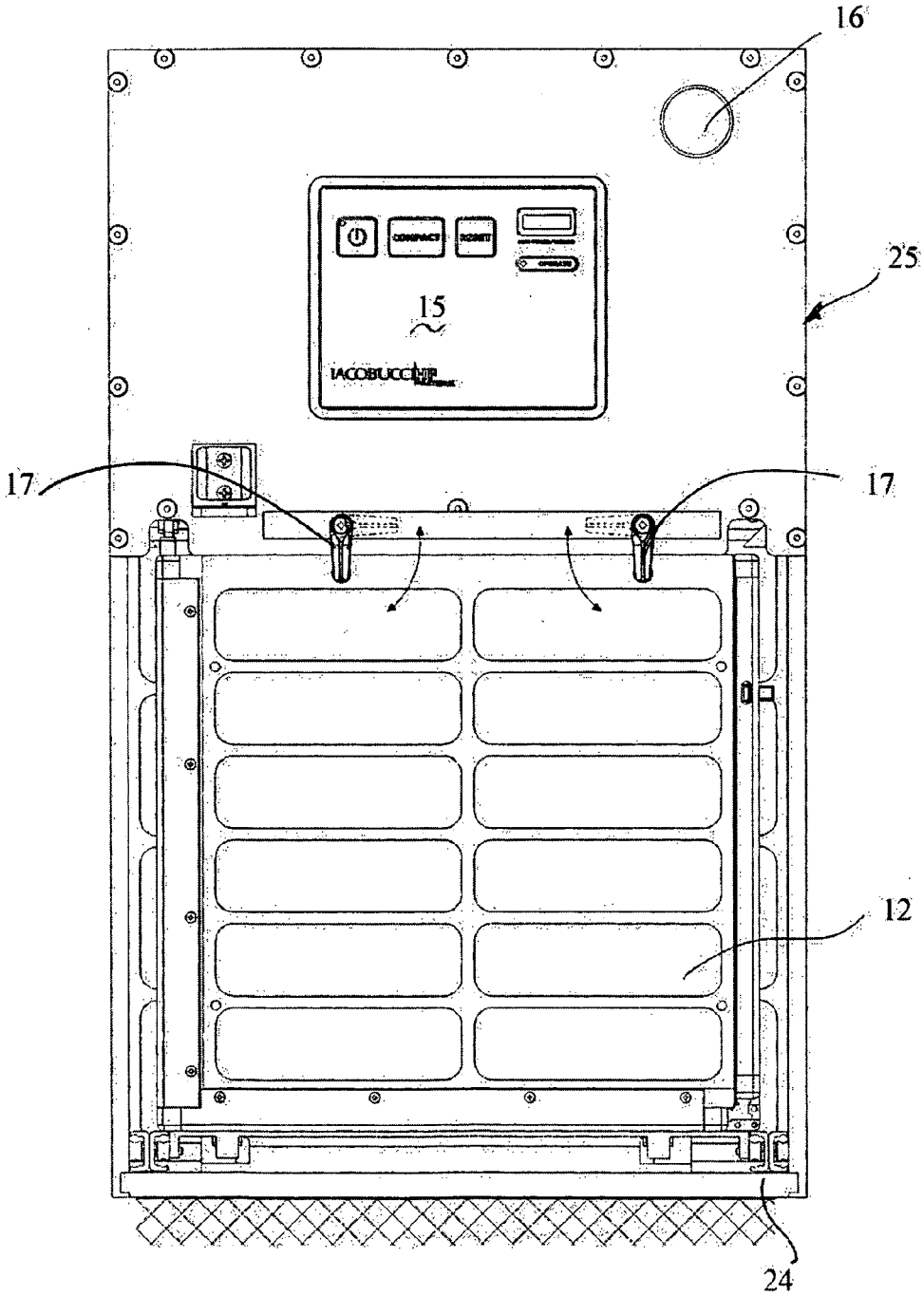

FIG. 8 is a schematic frontal view of the "case" of FIGS. 6 and 7.

DETAILED DESCRIPTION OF THE INVENTION

With reference to the appended FIGS. 1-4*c*, an embodiment of the waste compaction device of the invention is shown.

This waste compaction device comprises a fixed part and a mobile part.

The fixed part is preferably made with two superimposed horizontal supporting plates 9 and 10, with a space between them, and comprises an electro-mechanical device able to generate a rotary motion, typically an electric engine or rotary actuator 1 associated with a motor reducer 2 and at least a track or rail 7 fixed to its supporting elements 8, 8*a* and able to stabilize the movement of the mobile part. The rail passes inside the supporting plate 9 through an opening 30 and possibly through the supporting plate 10 in an opening 27.

To the shaft of the motor reducer 2 a first cogwheel 3 is fitted and engaged to a second cogwheel 3 fitted on an endless screw 4.

The endless screw 4, passing through an opening 28 obtained in the supporting plate 9, rotates inside a single nut with flange 5, made integral to an horizontal compaction plate 6, which belongs to the mobile part of the waste compaction device, by means of fixed connecting means, such as rigid rings 18, a box-type body 19, a sleeve 23 (FIG. 3*a*).

The sleeve 23 and the box-type body 19 are preferably and generically parallelepiped or cylindrical in shape. The sleeve 23 is conveniently fixed both to the nut 5 and to the box-type body 19, which is preferably made with metallic sheets, generically fixed with pins 20 to the compaction plate 6.

To the upper side of the body 19 is preferably fixed at least one displacement device on the rail 7, comprising a support 22 rigidly connected to a displacement guide 21 which is able to slide along the rail 7, the function of such flow device being to stabilize the movement of the compaction plate 6.

Preferably, the mobile part includes two displacement devices 21, 22, one positioned laterally on the opposite side with respect to motor 1, and one placed in rear position with respect to the frontal side of the compaction device.

The displacement devices 21, 22 are partially housed in the space between plate 9 and the supporting plate 10 thanks to the presence of openings 27 and 30 obtained respectively in plate 10 and in plate 9. In the same apertures 30 actually pass rails 7 (FIG. 4*a*) with which the displacement devices 21, 22 are engaged, comprising essentially a slide, preferably with a swallow tail profile, complementary to that of rail 7.

The rigid rings 18, which also work as a load distribution, connect between them the compaction plate 6 and the body 19 and are fixed preferably along the edges of the body 19 or possibly on its walls.

The waste compaction device of the invention is activated by the electric motor 1 and the motor reducer 2, which produces a rotary motion, transferred from the cogwheels 3, 3 to the endless screw 4, in turn engaged to the flange nut 5 that, integral to the horizontal compaction plate 6, allows its translation movement. The advantageous features such as compactness, lightness, and efficiency in terms of compression force transmission, that characterize the compactor according to the invention, are due to the ease and the efficacy of transfer of the rotary motion of the motor to the endless screw 4, which is transformed into a vertical rectilinear motion by the flange nut 5. This flange nut 5 is provided inside with an helical kinetic mechanism of the rolling friction type due to the presence of rolling bodies in the shape of spheres 5*a*, which carry out their action on the grooves 4*a* of the endless screw 4 (FIG. 4*c*). The vertical downward motion from and vice-versa thus created is subsequently transferred to the compaction plate 6 by means of the fixed connection means 18, 19 and 23. The compaction device according to the invention can be housed inside a bearing structure of a housing or "case", as shown in FIGS. 5 to 8, possibly fitted on wheels, that are, respectively, a schematic view in perspective of the waste compaction device of the invention and of the "case" wherein it is housed, and two vertical longitudinal sections and a frontal view of the compaction device and of the "case".

The movement of the compaction plate 6 allows compaction of waste in a container placed in a waste carrier space 11 below the device. (FIG. 5).

All the movement is electronically controlled by means of electronic components, which are not illustrated in detail in the figures.

The horizontal supporting plates 9 and 10, which belong to the fixed part are provided with means for the connection to a general bearing structure of the "case" in which it is possible to place the compactor. Advantageously, this bearing structure has a parallelepiped shape and comprises a base 24 and a framework 25.

The horizontal supporting plates 9 and 10, together with the bearing structure, allow the compaction load, generated to the combined action of the tangent screw 4 and of the nut with flange 5, to be absorbed from the fixed part and discharged on the base 24.

The compactor device according to the invention has a very reasonable weight with respect to analogous devices currently on the market. Moreover, the electric/electronic management system is very reduced. Finally, the metal plates have been manufactured ("unloaded") by making reduction notches and hollows 26 in order to minimize the weights.

The correct and efficient functioning of the compaction device can be controlled through a control board 15 which interfaces with an electronic section managed by a microprocessor with a software. In this way, the different use steps of the compactor can be managed by adequate coordination of the compaction functions, of the waste carrier bay opening, the cleaning of the inside, etc. In addition, the control display can be provided with the possibility of visualizing information such as the number of cycles and the hours worked and/or other useful indications for the compactor maintenance.

The control of the compactor functioning can be further guaranteed by means of the use of sensors in the compaction space, which can be, for example, of the microswitch-type, optic-type, magnetic-type, etc. Such sensors allow the adjustment of the compaction function activation and guarantee the operation of the machine in full safety. In particular, the presence/absence of the waste holding drawer in the compaction space is controlled by means of a microswitch. If the drawer is not positioned correctly, the compaction cycle cannot be performed. There are also full stroke microswitches to limit the vertical run of the compaction plate 6. An emergency button 16, to be used in conditions of critical breakdown, could be advantageously positioned on the control board or on the frontal side of the "case".

With particular reference to FIG. 5, an embodiment of the invention is illustrated wherein, as above mentioned, the compaction device is housed in the upper side of the "case" consisting in a rigid parallelepiped structure with a base 24 and posts 25, that has very reduced overall dimensions, in which a waste holding drawer 12 is possibly housed, inside section 11. FIG. 6 shows the "case" with the compaction plate 6 completely lowered in the drawer 12 to compact the waste. When the compactor is activated, the compaction plate 6 moves downwards in the drawer 12 to the required level for carrying out the compaction operations, that the latter can be in some cases the lowest level, in other cases it may depend on the force developed by the compactor; afterwards, automatically, the compaction plate 6 goes back to its initial position and stops. In this way it presses the waste and places itself so that it is possible to open the drawer 12.

FIG. 7 shows the "case" with the compaction plate 6 completely lifted and the drawer 12 taken out from the waste holding space 11. The "case" can be fixed on wheels (not shown) or can be inserted inside a trolley, such as for example an aeronautical trolley, to easily move it. In a advantageous embodiment, the "case" is provided with an appropriate mechanical or electro-mechanical device of the microswitch-type (not shown in the figures) to hold up the compaction operations when the drawer is open, in case of its accidental opening. It can be, moreover, provided an appropriate closing system 17 of the section 11 to block the drawer once it has been inserted. The compactor device according to the invention, thanks to the combination of its elements, is very compact, light, efficient from the point of view of electric power consumption and it is compatible with a 28 V power supply. It is, therefore, particularly fit to be installed in areas of very small dimensions, such as kitchen furniture or those present in light passenger aircrafts. The reduction of overall dimensions is obtained thanks to the possibility of a partial interpenetration of the mobile part within the fixed part through the apertures 30 in the supporting plate 9. As a matter of fact, through the apertures are the rails 7 onto which the slip devices 21, 22 of the mobile part of the compactor are engaged. With such building solution, it is possible to produce a compact, shockproof structure and, at the same time, to allow a quite long run of the compaction plate 6.

Moreover, the compactor device can be activated with low-voltage power and retains a high compression strength, similar to those developed by the traditional compactors, having a compression strength of almost 2000 kg/m$^2$ or more.

The device is also compatible with the aeronautical provisions in force.

The use of the compaction device according to the invention is not restricted to the aeronautical use, but it can be also employed on buses, coaches, trains, ships and vessels in general, caravans or in non-mobile environments, such as, for example: domestic environments, housing or office buildings, restaurants, hotels, canteens, hospitals, or, in particular, a kitchen or a waste collection space in a building, and in all the cases where it is necessary to compact waste in the presence of constricted spaces. The "case" and the compaction device can be manufactured with any material provided with the necessary strength features. In particular, for the use in the aeronautical field, the light metal alloys are preferred, such as the aluminium alloys. The particular embodiments herein described do not limit the scope of this application that covers all the variations of the invention defined by the claims.

The invention claimed is:

1. A waste compactor device comprising:

(a) a fixed part; and (b) a mobile part:

wherein the fixed part comprises an electro-mechanical device able to generate a rotary motion (1) between two supporting horizontal plates (9) and (10);

wherein the mobile part comprises:

a horizontal compaction plate (6), a flange nut (5) and an endless screw, wherein the horizontal compaction plate (6) is moved by the electro-mechanical device (1) through a mechanism comprising at least a first and a second cogwheel (3, 3) for the transmission of motion to the endless screw (4) which rotates inside the flange nut (5), which translates the rotary motion into a translational motion transmitting it to the horizontal compaction plate (6), wherein the first cogwheel 3 is fitted and engaged to the second cogwheel 3 fitted on the endless screw 4, wherein the two supporting horizontal plates (9) and (10) are overlapped and spaced out between them is housed the electro-mechanical device (1), at least one rail (7) fixed to supporting rail elements (8, 8*a*) integral to the supporting horizontal plate (9) and able to stabilize the movement of the mobile part, and the at least one rail passes inside the supporting horizontal plate 9 through an opening 30, and optionally the at least one rail passes through the supporting plate 10 in an opening 27, and at least a displacement device (21, 22) fixed to the mobile part to run on the rail (7), the supporting horizontal plate (9) acting as a retaining plate being provided in correspondence of the rail (7) with the opening (30) of the supporting horizontal plate (9) able to receive said displacement device (21, 22).

2. The waste compactor device according to claim 1, wherein the mobile part comprises two displacement devices (21, 22), one of the displacement devices is positioned laterally on an opposite side with respect to the electro-mechanical device (1), and the other one of the displacement devices is laced in a rear position with respect to a frontal side of the compactor device.

3. The waste compactor device according to claim 1, wherein the horizontal compaction plate (6), the supporting horizontal plate (10), the supporting element (8*a*) and the displacement device (22) comprise one or a plurality of openings (26) to reduce their weight.

4. A complex comprising:

(1) the waste compactor device; and (2) a waste holding drawer (12), the waste compactor device comprises:

(a) a fixed part; and (b) a mobile part:

wherein the fixed part comprises an electro-mechanical device able to generate a rotary motion (1) between two supporting horizontal plates (9) and (10);

wherein the mobile part comprises: a horizontal compaction plate (6), a flange nut (5) and an endless screw (4), wherein the horizontal compaction plate (6) is moved by the electro-mechanical device (1) through a mechanism comprising at least a first and a second cogwheel (3, 3) for the transmission of motion to the endless screw (4) which rotates inside the flange nut (5), which translates the rotary motion into a translational motion transmitting it to the horizontal compaction plate (6), wherein the first cogwheel (3) is fitted and engaged to the second cogwheel (3) fitted on the endless screw (4), wherein two supporting horizontal plates (9) and (10) are overlapped and spaced out between them is housed the electro-mechanical device (1), at least one rail (7) fixed to supporting rail elements (8, 8a) integral to the supporting horizontal plate (9) and able to stabilize the movement of the mobile part, and the at least one rail passes inside the supporting horizontal late (9) through an opening (30), and optionally the at least one rail passes through the supporting plate (10) in an opening (27), and at least a displacement device (21, 22) fixed to the mobile part to run on the rail (7), the supporting horizontal plate (9) acting as a retaining plate being provided in correspondence of the rail (7) with the opening (30) of the supporting horizontal plate (9) able to receive said displacement device (21, 22).

5. The waste compactor device of claim 2, wherein the displacement devices 21, 22 are partially housed in a space between the supporting horizontal plate 9 and the supporting horizontal plate 10 due to the presence of openings 27 and 30 contained respectively in supporting horizontal plate 9 and the supporting horizontal plate 10.

6. The waste compactor device of claim 1, wherein the endless screw 4, passes through an opening 28 in the supporting horizontal plate 9.

7. The waste compactor device of claim 6, wherein the fixed connection comprises at least one rigid ring 18, box-type body 19, or sleeve 23.

8. The waste compactor device of claim 7, wherein the sleeve 23 or the box-type body 19 are parallelepiped or cylindrical in shape.

9. The waste compactor device of claim 7, wherein the sleeve 23 is fixed both to a flange nut 5 and to the box-type body 19.

10. The waste compactor device of claim 7, wherein the box-type body 19 comprises or is made with metallic sheets.

11. The waste compactor device of claim 7, wherein the box-type body 19 is fixed with pins 20 to the horizontal compaction plate 6.

12. The waste compactor device of claim 7, wherein an upper side of the box-type body 19 is fixed to the at least one displacement device on the rail 7, and the at least one displacement device comprises a support 22 rigidly connected to a displacement guide 21 which is able to slide along the rail 7, the function of such flow device being to stabilize the movement of the horizontal compaction plate 6.

13. The waste compactor device of claim 7, wherein the at least one rigid ring 18, comprise two rigid rings which connect between them the horizontal compaction plate 6 and the box-type body 19.

14. The waste compactor device of claim 13, wherein the two rigid rings are fixed along the edges or the walls of the box-type body 19.

15. The waste compactor device of claim 1, wherein the electro-mechanical device able to generate a rotary motion is an electric motor or rotary actuator.

16. The waste compactor device of claim 1, wherein the electro-mechanical device is operably associated with a motor reducer 2.

17. The waste compactor device of claim 1, further comprising a sensor operably linked to the electro-mechanical device, wherein optionally the sensor is microswitch-type sensor, an optic-type sensor or a magnetic-type sensor, and optionally the sensor can limit a vertical run of the horizontal compaction plate 6.

18. The complex of claim 4, further comprising a sensor operably linked to the electro-mechanical device and a compaction space, wherein if the waste holding drawer is not positioned correctly, a compaction cycle cannot be performed.

19. A waste compactor device comprising:

(a) a fixed part; and (b) a mobile part:

wherein the fixed part comprises an electro-mechanical device able to generate a rotary motion (1) between two supporting horizontal plates (9) and (10);

wherein the mobile part comprises:

a horizontal compaction plate (6), a flange nut (5) and an endless screw, wherein the horizontal compaction plate (6) is moved by the electro-mechanical device (1) through a mechanism comprising at least a first and a second cogwheel (3, 3) for the transmission of motion to the endless screw (4) which rotates inside the flange nut (5), which translates the rotary motion into a translational motion transmitting it to the horizontal compaction plate (6), wherein the first cogwheel 3 is fitted and engaged to the second cogwheel 3 fitted on the endless screw 4, wherein two supporting horizontal plates (9) and (10) are overlapped and spaced out between them is housed the electro-mechanical device (1), at least one rail (7) fixed to supporting rail elements (8, 8*a*) integral to the supporting horizontal plate (9) and able to stabilize the movement of the mobile part, and the at least one rail passes inside the supporting horizontal plate 9 through an opening 30, and optionally the at least one rail passes through the supporting plate 10 in an opening 27, and at least a displacement device (21, 22) fixed to the mobile part to run on the rail (7), the supporting horizontal plate (9) acting as a retaining plate being provided in correspondence of the rail (7) with the opening (30) of the supporting horizontal plate (9) able to receive said displacement device (21, 22), and a sensor operably linked to the electro-mechanical device.

* * * * *